US009752545B2

(12) United States Patent
Nishimura

(10) Patent No.: US 9,752,545 B2
(45) Date of Patent: Sep. 5, 2017

(54) FUEL INJECTION CONTROL APPARATUS

(71) Applicant: DENSO CORPORATION, Kariya, Aichi-pref. (JP)

(72) Inventor: Toshio Nishimura, Anjo (JP)

(73) Assignee: DENSO CORPORATION, Kariya (JP)

( * ) Notice: Subject to any disclaimer, the term of this patent is extended or adjusted under 35 U.S.C. 154(b) by 1113 days.

(21) Appl. No.: 13/922,391

(22) Filed: Jun. 20, 2013

(65) Prior Publication Data

US 2014/0034025 A1 Feb. 6, 2014

(30) Foreign Application Priority Data

Aug. 1, 2012 (JP) ..... 2012-171127

(51) Int. Cl.
*F02D 41/20* (2006.01)
*F02M 69/04* (2006.01)

(52) U.S. Cl.
CPC ..... *F02M 69/04* (2013.01); *F02D 41/20* (2013.01); *F02D 2041/2055* (2013.01); *F02D 2041/2058* (2013.01)

(58) Field of Classification Search
CPC ..... F02D 2041/2055; F02D 2041/2058; F02D 2041/2003; F02D 41/20; F02D 41/40; F02D 41/401; H01F 2007/185; F02M 59/466; F02M 37/08
USPC ..... 123/472, 490, 499, 478
See application file for complete search history.

(56) References Cited

U.S. PATENT DOCUMENTS 4,612,597 A * 9/1986 Hamren ..... F02D 41/20 123/490
5,182,517 A * 1/1993 Thelen ..... F02D 41/20 324/418
5,375,575 A * 12/1994 Ohishi ..... F02D 41/0085 123/446
6,497,221 B1 * 12/2002 French ..... F02M 51/0682 123/478
2012/0179413 A1 * 7/2012 Hasse ..... G01D 1/00 702/122
2013/0104636 A1 * 5/2013 Beer ..... F02D 41/20 73/114.49

FOREIGN PATENT DOCUMENTS

DE WO 2011006757 A1 * 6/2010
DE WO 2011006757 A1 * 1/2011 ..... G01D 1/00
DE WO 2011134794 A1 * 11/2011
JP 58-13133 1/1983
JP 9-116231 5/1997

(Continued)

*Primary Examiner* — Mahmoud Gimie
*Assistant Examiner* — Josh Campbell
(74) *Attorney, Agent, or Firm* — Nixon & Vanderhye PC

(57) ABSTRACT

In a fuel injection control apparatus, an injector is driven to open its valve by supplying a coil of the injector with a current during a high-level period of a power supply command signal outputted from a microcomputer. A valve-closing time of the injector is detected based on a coil current, which decreases from a fall time of the power supply command signal. By comparing the coil current with plural equally-divided comparison threshold values by comparators, times are detected when the coil current decreases to the comparison threshold values, respectively. The valve-closing time is detected based on time differences among the detected times.

12 Claims, 7 Drawing Sheets

(56) References Cited

FOREIGN PATENT DOCUMENTS

| | | |
|---|---|---|
| JP | 2009-296721 | 12/2009 |
| JP | 2010-73705 | 4/2010 |
| JP | 2010-532448 | 10/2010 |

* cited by examiner

FUEL INJECTION CONTROL APPARATUS

CROSS REFERENCE TO RELATED APPLICATION

This application is based on and incorporates herein by reference Japanese patent application No. 2012-171127 filed on Aug. 1, 2012.

FIELD

The present disclosure relates to a fuel injection control apparatus for driving an electromagnetic solenoid-type injector, which opens a valve thereof when power is supplied to a coil thereof.

BACKGROUND

As injectors (fuel injection valves) for injecting fuel into cylinders of an internal combustion engine mounted on a vehicle, an electromagnetic solenoid-type injector is used. This injector is driven to open its valve when its coil is powered by electric current. A fuel injection control apparatus, which controls fuel injection to the internal combustion engine by driving the injector, controls a fuel injection time and a fuel injection quantity by controlling a drive start time and a drive period. The drive start time is a time point of starting a power supply operation for supplying current to a coil. The drive period is a time interval for continuing the power supply operation from the drive start time.

It is proposed in this kind of fuel injection control apparatus to detect a characteristic of the injector and correct the drive period or the like of the injector in accordance with the detected value (for example, in accordance with a quantity of deviation of the detected value from a reference value).

As one technology for detecting the characteristic of an injector, JP 2010-532448A, for example, discloses calculation of a period (closing period), which starts from a start time of a valve closing process to a valve closing time as the injector characteristic. The valve closing time of the injector is detected based on a differential value calculated by differentiating a current of the coil, which decreases from the start time of the closing process (corresponding to an end time of the drive period) of the electromagnetic valve corresponding to the injector. Further, JP 2010-532448A discloses that, for realizing a required fuel injection quantity, the drive control continuation period (corresponding to the drive period) is calculated by using the calculated valve-closing time.

According to the fuel injection control apparatus disclosed in JP 2010-532448A, the differential value of the current of the coil (coil current) is calculated by analog/digital-converting the coil current by an analog/digital converter (ADC) at every predetermined interval and differentiating each A/D-converted value.

This calculation increases processing load and needs an A/D conversion channel of the A/D converter in the fuel injection control apparatus.

SUMMARY

It is therefore an object to provide a fuel injection control apparatus, which detects a valve-closing time of an injector without A/D conversion and differentiation of a coil current.

According to one aspect, a fuel injection control apparatus is provided for an injector having a coil and a valve, the fuel injection control apparatus comprises a setting part, a drive control part and a detection part. The setting part sets a drive period of the injector. The drive control part drives the injector to open the valve by starting a power supply operation of supplying a power voltage to the coil of the injector to supply a current to the coil at a start time of the drive period set by the setting part, and stops the power supply operation to close the valve at an end time of the drive period. The detection part detects a valve-closing time of the injector based on the coil current, which decreases from the end time of the drive period. The detection part detects, by comparing the coil current with each of plural comparison threshold values, each time that the coil current decreases to each of the plural comparison threshold values, and detects the valve-closing time based on detected times.

DETAILED DESCRIPTION OF THE EMBODIMENT

A fuel injection control apparatus according to plural embodiments will be described with reference to the drawings.

First Embodiment

Figure 1:
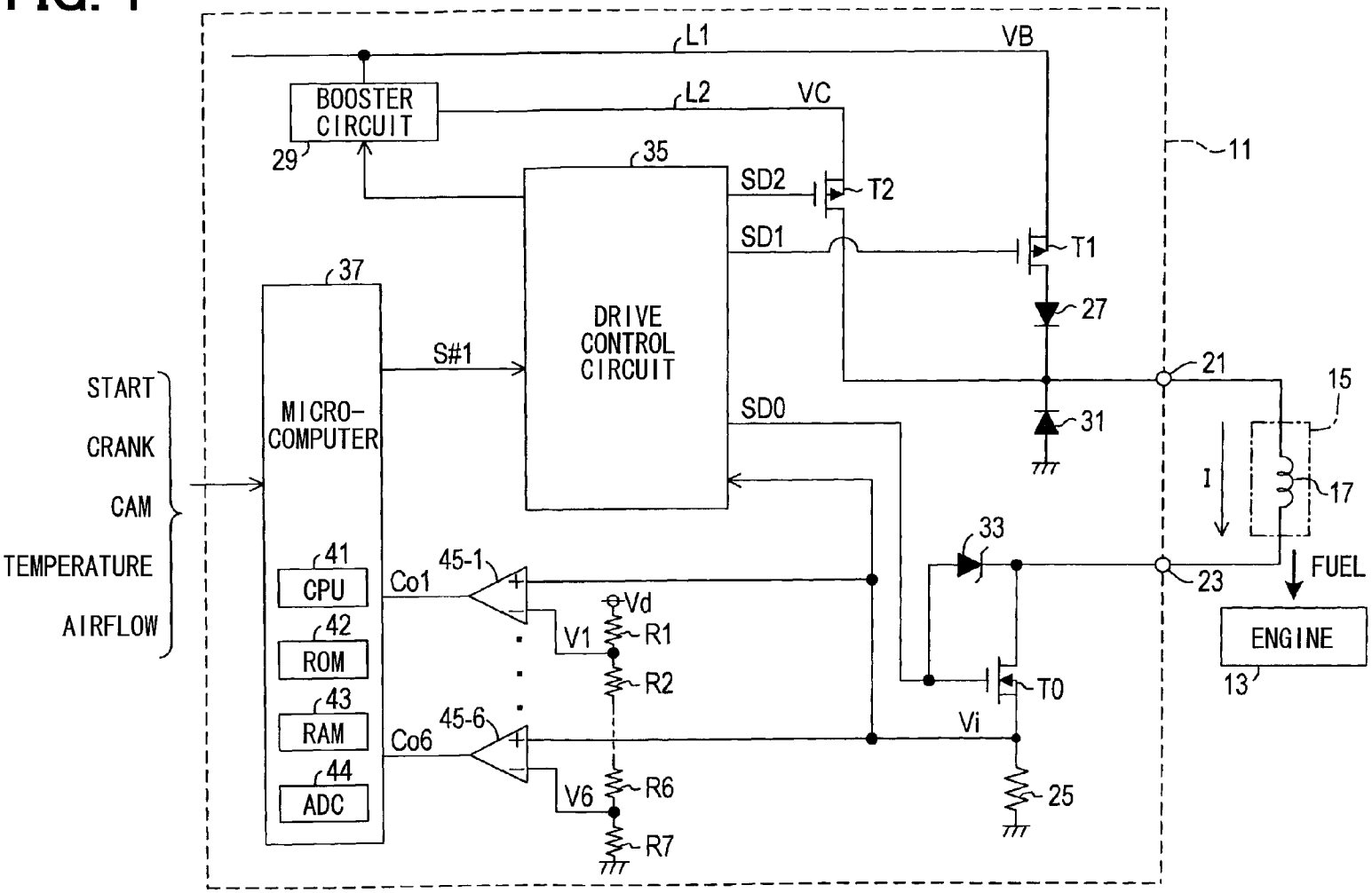
FIG. 1 is a circuit diagram showing a fuel injection control apparatus according to a first embodiment.

Referring to FIG. 1, a fuel injection control apparatus 11 is provided to drive each injector 15, which injects fuel into each cylinder of a multi-cylinder internal combustion engine 13 (for example, four cylinders) mounted on a vehicle.

The injector 15 is a conventional solenoid-type injector, which includes a solenoid as a valve-opening actuator. That is, in the injector 15, when a coil 17 of the built-in solenoid is powered, a valve member is moved to a valve-opening position by electromagnetic force of the coil 17 so that the injector 15 injects fuel in its valve-opening state. When power supply to the coil 17 is stopped, the valve member is returned to a valve-closing position so that the injector 15 stops fuel injection in its valve-closing state.

The fuel injection control apparatus 11 thus controls both the period and the time of power supply to the coil 17 of the injector 15 thereby to control fuel injection quantity and fuel injection time for each cylinder of the engine 13.

In FIG. 1, only one injector 15 corresponding to, for instance, the first cylinder is shown among plural injectors 15. Driving of the injector 15 of the first cylinder will be described as an example. A transistor such as a MOSFET is used as a switching element for turning on and off. However, other types of switching elements such as a bipolar transistor may be used.

The fuel injection control apparatus 11 is provided with a terminal 21, a terminal 23, a transistor T0 and a current detecting resistor 25. The terminal 21 is connected to one end (high-potential side) of the coil 17 of the injector 15. The terminal 23 is connected to the other end (low-potential side) of the coil 17. The transistor T0 is connected to the terminal 23 at one output terminal thereof as a low-potential side switching element. The current detecting resistor 25 is connected between the other output terminal of the transistor T0 and a ground line (line of ground potential) to convert the coil current I flowing in the coil 17 to a voltage Vi.

Although not shown, the terminal 21 is a common terminal for the injector 15 of each cylinder. The coil 17 of each injector 15 is connected to the terminal 21. The terminal 23 and the transistor T0 are provided for the coil 17 of each injector 15. The transistor T0 is referred to as a cylinder selecting switch, because it operates as a switch, which selects an injector 15 as a driving object. An N-channel MOSFET is used as the transistor T0.

The fuel injection control apparatus 11 is further provided with a constant current supplying transistor T1, a reverse-flow preventing diode 27, a booster circuit 29 and an inrush current supplying transistor T2. The transistor T1 is connected at one output terminal thereof to a power line L1, to which a battery voltage VB of an in-vehicle battery is supplied. The diode 27 is connected at an anode thereof to the other output terminal of the transistor T1 and connected at a cathode thereof to the terminal 21. The booster circuit 29 boosts the battery voltage VB and outputs a voltage VC (>VB) for driving the injector 15 to quickly open a valve. The transistor T2 is connected at one output terminal thereof to a power line L2, to which the voltage VC is supplied from the booster circuit 29, and connected at the other output terminal thereof to the terminal 21. The transistors T1 and T2 are, for example, P-channel MOSFETs.

The fuel injection control apparatus 11 is further provided with a flywheeling diode 31, an arc-suppressing Zener diode 33, a drive control circuit 35 and a microcomputer 37. The diode 31 is connected at an anode thereof to the ground line and connected at a cathode thereof to the terminal 21. The Zener diode 33 is connected at a cathode thereof to the terminals 23 and a drain of the transistor T0 and is connected at an anode thereof to a gate of the transistor T0. The drive control circuit 35 controls the transistors T0, T1, T2 and the booster circuit 29.

The diode 31 flywheels a current from the ground line, which is the low-potential side of the transistor T0, to the high-potential side of the coil 17, when one of the transistors T1 and t2 in the on-state is switched over to the off-state under a condition that the transistor T0 is in the on-state.

The Zener diode 33 is provided to consume and suppress a counter-electromotive force generated in the coil 17, when one of the transistors T1 and T2 in the on-state is switched over to the off-state and the transistor T0 is switched from the on-state to the off-state. At this time, a drive signal SDO outputted from the drive control circuit 35 to the gate of the transistor T0 changes from a high-level to a low-level and the transistor T0 tends to switch over its state from the on-state to the off-state. However, since the coil 17 stores electromagnetic energy therein, a flyback voltage (counter-electromotive force) greater than the battery voltage VB is generated at the terminal 23. Due to this flyback voltage, a Zener current flows from the cathode side to the anode side in the Zener diode 33. With this Zener current, the gate voltage of the transistor T0 is raised so that the transistor T0 turns on in its active region and the current corresponding to the electromagnetic energy continues to flow in the coil 17 through the transistor T0. Thus the counter-electromotive force generated by the electromagnetic energy is consumed mostly by the transistor T0. As a result, the coil current I decreases more quickly in comparison to a case, in which one of the transistors T1 and T2 is switched over from the on-state to the off-state under the condition that the transistor T0 is controlled to be in the on-state by the drive control circuit 35.

Assuming that a Zener voltage of the Zener diode 33 is Vz and a threshold value of a gate voltage, at which the transistor T0 starts to turn on, is Vth, a drain voltage of the transistor T0 (voltage at terminal 23) is Vz+Vth when the transistor turns on in the active region by the Zener diode 33.

The microcomputer 37 is provided with a CPU 41 for executing programs, a ROM 42 for storing therein the programs to be executed, a RAM 43 for storing arithmetic operation results and the like of the CPU 41 therein, an A/D converter (ADC) 44 and the like.

The microcomputer 37 is inputted with a start signal, a crank sensor signal, a cam sensor signal, a signal of a coolant temperature sensor (coolant temperature sensor signal), a signal of an airflow meter (airflow meter signal) and the like, as signals for controlling the engine. The start signal changes to a high-level when a condition for starting the engine 13 is satisfied. The crank sensor signal is outputted from a crank sensor in accordance with rotation of a crankshaft of the engine 13. The cam sensor signal is outputted from a cam sensor in accordance with rotation of a camshaft of the engine 13. The coolant temperature sensor detects a coolant temperature of the engine 13. The airflow meter detects an intake air quantity of the engine 13.

In the fuel injection control apparatus 11, the battery voltage VB is supplied to the power line L1 when a vehicle is set to an ignition-on state by a predetermined switching operation of a driver of the vehicle. From this battery voltage VB, a constant voltage (for example, 5V) for operating the microcomputer 37 and the drive control circuit 35 is generated by a power circuit, which is not shown. Thus the microcomputer 37 starts to operate when the vehicle is set to the ignition-on state. The ignition-on state corresponds to a state, in which the battery voltage VB is supplied to a line of an ignition power source in the vehicle.

When the microcomputer 37 detects, after starting its operation, that the start signal is switched over to the high-level, the microcomputer 37 makes a cylinder identification (specification of a rotational position of the crankshaft) based on the crank sensor signal and the cam sensor signal to determine the fuel injection time for each cylinder. Since various cylinder identification methods are known conventionally and any one of them is usable, no further description will be made.

After completing the cylinder identification, the microcomputer 37 executes fuel injection control processing thereby to control the injector 15 of each cylinder through the drive control circuit 35 based on the cylinder identification result, an engine rotation speed calculated based on the crank sensor signal and other operating information detected by the coolant temperature sensor signal, the airflow meter signal and the like.

More specifically, the microcomputer 37 determines, with respect to each cylinder, whether a multiple-stage injection should be performed. If the multiple-stage injection should be performed, the microcomputer 37 determines the number of injections in each multiple-stage injection and the drive start time and the drive period of the injector 15 for each fuel injection. The drive start time of the injector 15 corresponds to the injection start time and the drive period of the injector 15 corresponds to the injection period. The microcomputer 37 generates and outputs to the drive control circuit 35 a power supply command signal, which commands power supply to the injector 15, based on the determined drive start time and the drive period.

The power supply command signal indicates that the injector 15 is driven (that is, coil 17 of injector 15 is powered) only while the power supply command signal is at an active level. The power supply command signal therefore is set to take the active level (for example, high-level) from the determined drive start time and during the determined drive period.

The microcomputer 37 thus determines a drive duration (drive start time and drive period) of the injector 15 with respect to each cylinder based on the operating information such as the engine rotation speed, and sets the power supply command signal for the corresponding cylinder to the high-level only during the drive duration. That is, the microcomputer 37 determines, in the fuel injection control processing, a rise time (change time from low-level to high-level) of the power supply command signal and a high-level duration of the power supply command signal.

The multi-stage injection injects fuel multiple times from the injector 15 by dividing fuel required for one combustion in each cylinder into a multiple of portions. The operation of the microcomputer 37 is attained by the CPU 41, which executes the programs stored in the ROM 42 in the microcomputer 37.

The booster circuit 29 is, for example, a conventional voltage step-up DC/DC converter, which charges a capacitor with a flyback voltage generated in a coil (inductor) by chopper control of the coil.

The drive control circuit 35 controls the booster circuit 29 to perform a boosting operation so that the output voltage VC (charge voltage of the capacitor) of the booster circuit 29 attains a fixed target voltage (for example, 80 V), when the power supply command signals outputted from the microcomputer 37 for the cylinders are all at the low-level (that is, in a period the injector is not driven).

A basic operation of the drive control circuit 35 will be described with reference to a time chart of FIG. 2. As described above, the power supply command signal for each cylinder is inputted from the microcomputer 37 to the drive control circuit 35, the following description will be made with respect to the first cylinder.

Figure 2:
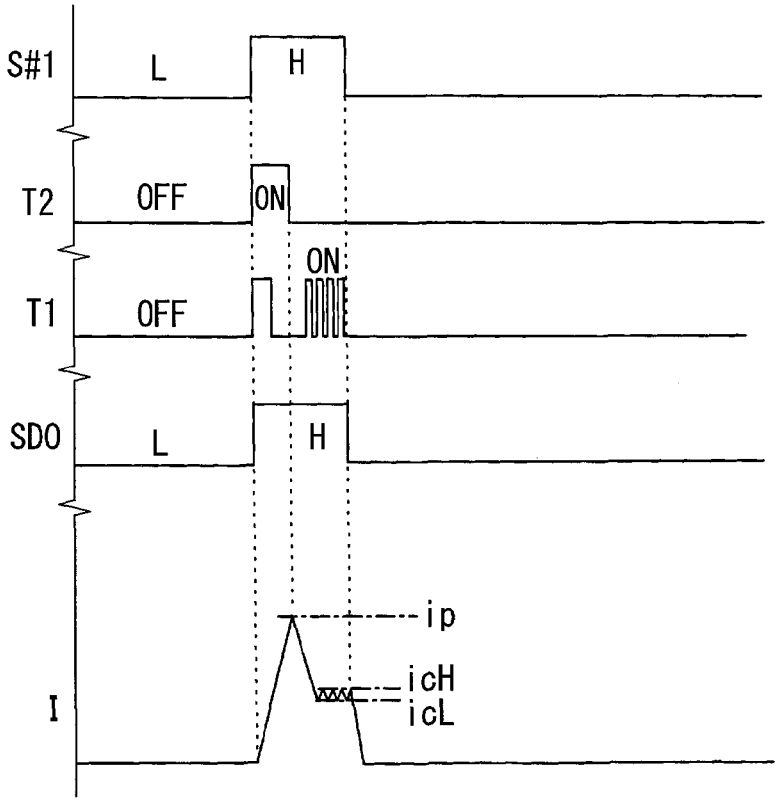
FIG. 2 is a time chart showing a basic operation of a drive control circuit in the first embodiment.

As shown in FIG. 2, when the power supply command signal S#1 for the first cylinder inputted from the drive control circuit 35 changes from the low-level (L) to the high-level (H), the drive control circuit 35 starts a powering operation of supplying power voltage to the coil 17 for flowing a current in the coil 17 of the injector 15. Specifically, the drive control circuit 35 starts to control driving of the transistors T1 and T2 and turns on the transistor T0 by changing the drive signal to the transistor T0 corresponding to the first cylinder to the high-level.

The drive control for the transistors T1 and T2 includes (1) inrush current control and (2) constant current control. Since the transistor T1 is a P-channel MOSFET, the drive control circuit 35 turns on the transistor T1 by changing the drive signal SD1 for the transistor T1 to the low-level and turns off the transistor T1 by changing the drive signal SD1 to the high-level. Similarly, since the transistor T2 is also a P-channel MOSFET, the drive control circuit 35 turns on the transistor T2 by changing the drive signal SD2 for the transistor T2 to the low-level and turns on the transistor T2 by changing the drive signal SD2 to the high-level.

(1) Inrush Current Control

The drive control circuit 35 starts inrush current control when the power supply command signal S#1 changes from the low-level to the high-level, and turns on the transistor T2 first.

The voltage VC is then applied from the booster circuit 29 to the terminal 21 and also to the coil 17 of the injector 15 so that power supply to the coil 17 is started. At this time, as indicated as a part of the coil current I in FIG. 2, the inrush current flows to drive the injector 15 to open its valve quickly.

The drive control circuit 35 detects the coil current I based on the voltage Vi (specifically, a potential difference between both ends of the resistor 25 and referred to as a current detection voltage below) developed by the resistor 25 after turning on the transistor T2. The drive control circuit 35 then turns off the transistor T2 when the detected coil current I rises to a peak value ip, which is preset in the drive control circuit 35. The voltage Vi is a voltage determined as a product of the coil current I and a resistance value of the resistor 25.

By this inrush current control, for starting power supply to the coil 17, the transistor T2 turns on together with the transistor T0 to supply the voltage VC, which is higher than the battery voltage VB, to the high-potential side of the coil 17. Thus the valve-opening response of the injector 15 is speeded up.

(2) Constant Current Control

The drive control circuit 35 starts the constant current control, which supplies a constant current to the coil 17 of the injector 15, when the power supply command signal S#1 is changed from the low-level to the high-level. This constant current control turns on and off the transistor T1, which is provided to supply the constant current, so that the coil current I detected as the current detection voltage Vi is regulated to the constant current, which is required to maintain the valve open and smaller than the peak value ip.

In the constant current control, as shown in FIG. 2, the transistor T1 is turned on when the coil current I becomes equal to or lower than a low-side threshold value icL and is turned off when the coil current I becomes equal to or higher than a high-side threshold value icH. The low-potential side threshold value icL, the high-potential side threshold value icH and the peak value ip are set to satisfy a predetermined relation, that is, $icL<icH<ip$.

When the coil current I decreases from the peak value ip to the low-potential side threshold value icL due to turning off of the transistor T2, the transistor T1 is turned on and off repetitively by the constant current control thereafter. As a result, the average value of the coil current I is regulated to the constant current between the high-potential side threshold value icH and the low-potential side threshold value icL. While the transistor T1 is in the on-state, the battery voltage VB is supplied as the power voltage to the high-potential side of the coil 17 and the current flows to the coil 17 through the transistor T1 and the diode 27. While the transistor T1 is in the off-state, the current (flywheeling current) flows from the ground line side through the diode 31.

With this constant current control, the constant current flows in the coil 17 after the transistor T2 is turned off. This constant current maintains the injector 15 in the valve-opening state. As shown in FIG. 2, the transistor T1 is turned on for only a short period after the power supply command signal S#1 becomes high because of this constant current control. That is, this is because the transistor T1 is maintained in the on-state, after the power supply command signal S#1 becomes the high-level until the coil current I reaches the high-potential side threshold value icH. However, since the voltage VC of the booster circuit 29 is higher than the battery voltage VB, the current flows to the coil 17 with the voltage VC as the power source while the transistor T2 is in the on-state, even when the transistor T1 is turned on. For this reason, the result is the same even in a case that the constant current control is started when the coil current I decreases to the low-potential side threshold value icL after the transistor T2 is turned off by the inrush current control.

FIG. 2 shows an exemplary case, in which the coil current I is controlled to only one constant current with the low-potential side threshold value icL and the high-potential side threshold value icH being both fixed continuously. However, the control may be changed to switching control, which switches the low-potential side threshold value icL and the high-potential side threshold value icH to smaller values after an elapse of a predetermined period from the start of powering the coil 17 thereby to control the coil current I to a lower constant current.

The drive control for the transistors T1 and T2 are performed as described above. When the power supply command signal S#1 of the microcomputer 37 is changed from the high-level to the low-level (that is, the drive period of the injector is finished) thereafter, the drive control circuit 35 stops the powering operation of the coil 17. By finishing the drive control of the transistors T1 and T2 and maintaining the transistors T1 and T2 in the off-state, the drive control circuit 35 stops power supply of the power voltage (VC or VB) to the high-potential side of the coil 17. The drive control circuit 35 changes the drive signal SD0 to the transistor T0 to the low-level to turn off the transistor T0 as well. Then the coil current I decreases and the injector 15 closes its valve thereby finishing the fuel injection by the injector 15.

According to the first embodiment, as shown in FIG. 1, the fuel injection control apparatus 11 is provided with n-number of comparators 45-1 to 45-N in correspondence to n-number of comparison threshold values as a part for comparing the coil current I with n-number of comparison threshold values I1 to In. "n" is an integer equal to 3 or more.

Although the following description will be made with an assumption of n=6, for example, the number "n" (that is, the number of comparison threshold values) may be other than 6. The current detection voltage Vi of the resistor 25 is inputted to non-inverting input terminals (+terminals) of the comparators 45-1 to 45-6.

The fuel injection control apparatus 11 is provided, as a part for generating threshold value voltages V1 to V6 corresponding to the six comparison threshold values I1 to I6, respectively, with seven resistors R1 to R7 connected in series between a predetermined fixed voltage Vd (for example, 5 V) and the ground line. Among voltages at six junctions between adjacent two of resistors R1 to R7, the voltage decreases in the order from V1 to V6. The threshold value voltages V1 to V6 are applied to inverting input terminals of the comparators 45-1 to 45-6 as comparison threshold value voltages to be compared with the current detection voltage Vi, respectively.

Each threshold value voltage Vm ("m" is any one of 1 to 6) is a voltage determined by multiplication of the comparison threshold value Im as the current value by the resistance value of the resistor 25. This voltage is equal to the current detection voltage Vi, which is developed when the current of the comparison threshold value Im flows to the resistor 25.

Each comparator 45-*m* compares the current detection voltage Vi inputted to the non-inverting input terminal with the threshold value voltage Vm inputted to the inverting input terminal. The comparator 45*m* sets its output Com to the high-level and the low-level in response to Vi>Vm and Vi_Vm, respectively. Each comparator 45*m* thus compares the coil current I with the comparison threshold value Im by comparing the current detection voltage Vi with the threshold value voltage Vm.

The outputs Co1 to Co6 of the comparators 45-1 to 45-6 are inputted to the microcomputer 37. The differences between adjacent two among the comparison threshold values I1 to I6 are equal one another and hence the differences among the threshold value voltage V1 to V6 are also equal one another. That is, the comparison threshold values I1 to I6 and hence the threshold voltages V1 to V6 are equally spaced. For this purpose, the resistances of the resistors R1 to R7 are set to be equal one another.

Figure 3:
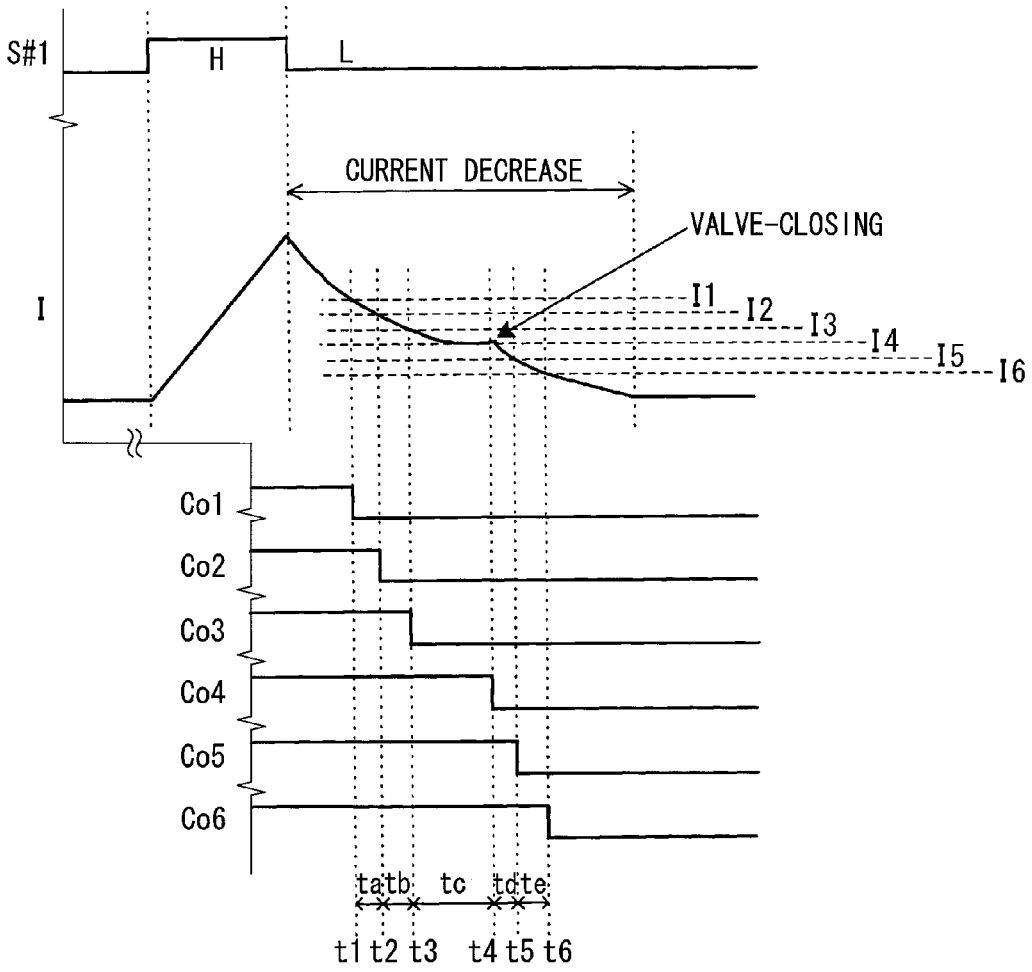
FIG. 3 is a time chart showing an operation of the first embodiment.

In the fuel injection control apparatus 11, as shown in FIG. 3, the output Co1 of the comparator 45-1 changes from the high-level to the low-level, when the coil current I decreases to the comparison threshold value I1, which is the maximum of the comparison threshold values I1 to I6, during a current decrease period, which is from the fall time of the power supply command signal S#1 (change time from the high-level to the low-level and end time of the drive period) to the zero-current time, at which the coil current I decreases to 0.

When the coil current I thereafter decreases to the comparison threshold value I2, which is lower subsequent to the comparison threshold value I1, the output Cot of the comparator 45-2 changes from the high-level to the low-level. When the coil current I decreases to the comparison threshold value I3, which is lower subsequent to the comparison threshold value I2, the output Co3 of the comparator 45-3 changes from the high-level to the low-level. When the coil current I further decreases to the comparison threshold value I4, which is lower subsequent to the comparison threshold value I3, the output Co4 of the comparator 45-4 changes from the high-level to the low-level. When the coil current I decreases to the comparison threshold value I5, which is lower subsequent to the comparison threshold value I4, the output Co5 of the comparator 45-5 changes from the high-level to the low-level. When the coil current I decreases to the comparison threshold value I6, which is the minimum and lower subsequent to the comparison threshold value I5, the output Co6 of the comparator 45-6 changes from the high-level to the low-level.

FIG. 3 exemplifies a case, in which the high-level period of the power supply command signal S#1 (drive period of the injector 15) is very short and the power supply command signal S#1 is changed to the low-level before the coil current I attains the peak value ip after the power supply command signal S#1 is set to the high-level (that is, in the course of performing the inrush current control). Accordingly, in this exemplary case, the transistor T2 is turned off from the on-state and the transistor T0 is also turned off at the fall time of the power supply command signal S#1. On the other hand, when the power supply command signal S#1 is changed to the low-level during a period, in which the transistor T1 is turned on and off by the constant current control (transistor T2 is already in the off-state at this time), the constant current control is finished at the fall time of the power supply command signal S#1. Thus, the transistor T1 is not turned on any more and the transistor T0 is turned off. In this case, the coil current I decreases from the constant current of the constant current control.

Valve-closing time detection processing, which the microcomputer 37 executes for detecting the valve-closing time of the injector 15, will be described next with reference to FIG. 4 in view of the foregoing description. This valve-closing time detection processing is started at every fall time of the power supply command signal S#1, for example. As another example, the valve-closing time detection processing may be started at only the fall time of the power supply command signal S#1, which has a high-level period set to a predetermined period by the fuel injection control processing.

Figure 4:
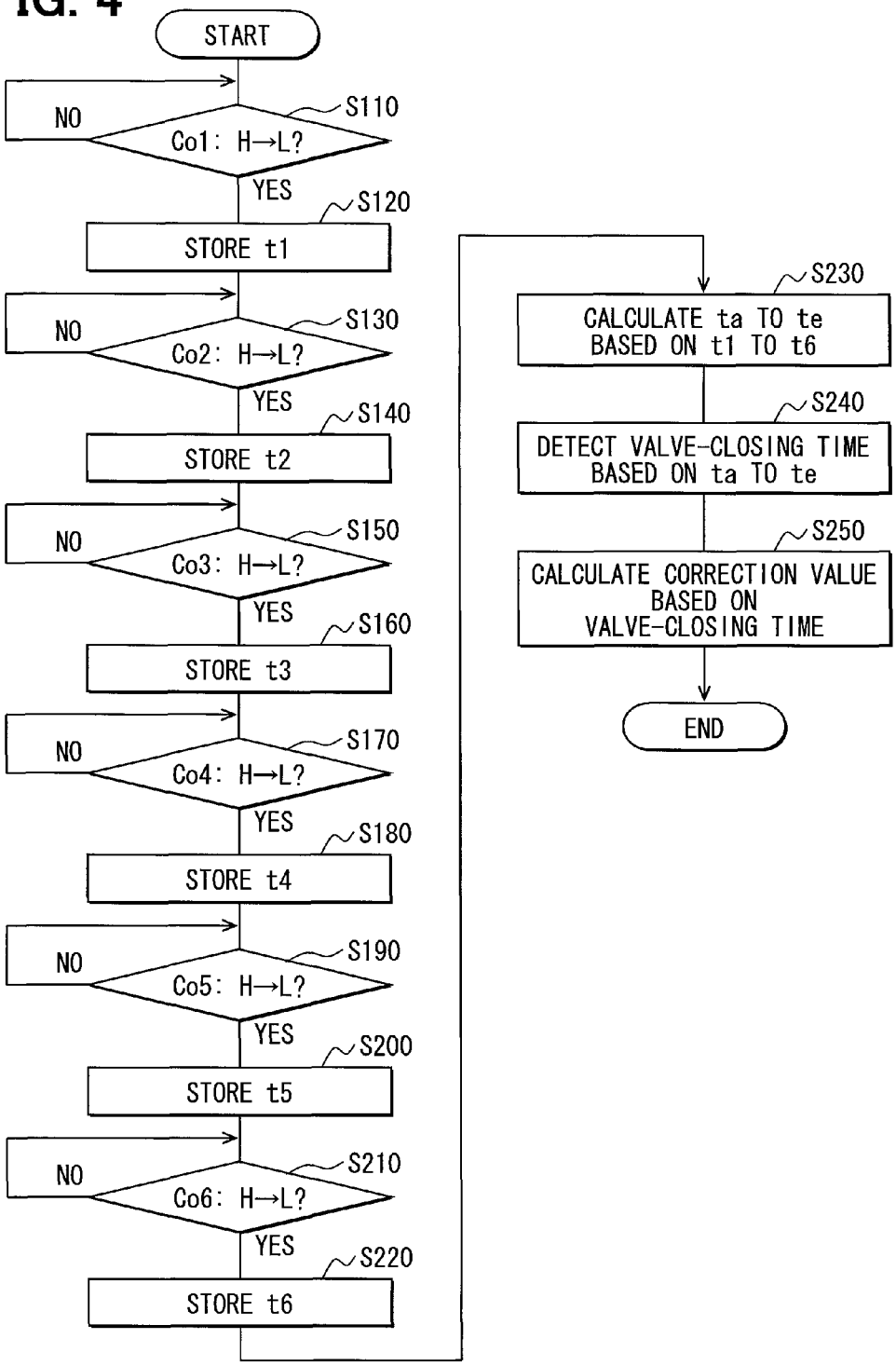
FIG. 4 is a flowchart showing valve closing time detection processing executed by a microcomputer in the first embodiment.

As shown in FIG. 4, the microcomputer 37 first waits at S110 until the output Co1 of the comparator 45-1 changes (that is, falls) from the high-level (H) to the low-level (L) after starting the valve-closing time detection processing. When the output Co1 of the comparator 45-1 changes from the high-level to the low-level, the microcomputer 37 determines that the coil current I fell to the comparison threshold value I1 and executes S120. The microcomputer 37 stores at S120 this time in the RAM 43 and then executes S130.

Thus, the fall of the coil current I to the comparison threshold value I1 is detected by S110 and this time t1 (time t1 in FIG. 3) is stored in the RAM 43 by S120.

The microcomputer 37 resets a time-measuring timer (not shown) at the start time of the valve-closing detection processing, that is, the fall time of the power supply command signal S#1, which is also the end time of the drive period of the injector 15 and the start time of the current decrease period. The microcomputer 37 stores at S120 a measured value of the timer (timer value) in the RAM 43 as the present time. That is, the RAM 43 stores the time, which elapses from the fall time of the power supply command signal S#1 used as a reference time. This also applies to S140, S160, S180, S200 and S220 described below.

The microcomputer 37 waits at S130 until the output Co2 of the comparator 45-2 changes from the high-level to the low-level. When the output Co2 changes from the high-level to the low-level, the microcomputer 37 determines that the coil current I fell to the comparison threshold value I2 and executes S140. The microcomputer 37 stores at S150 this time t2 in the RAM 43 and then executes S140.

Thus, the fall of the coil current I to the comparison threshold value I2 is detected by S130 and this time t2 (time t2 in FIG. 3) is stored in the RAM 43 by S120.

The microcomputer 37 waits at S150 until the output Co3 of the comparator 45-3 changes from the high-level to the low-level. When the output Co3 changes from the high-level to the low-level, the microcomputer 37 determines that the coil current I fell to the comparison threshold value I3 and executes S160. The microcomputer 37 stores at S160 this time t3 in the RAM 43 and then executes S170.

Thus, the fall of the coil current I to the comparison threshold value I3 is detected by S150 and this time t3 (time t3 in FIG. 3) is stored in the RAM 43 by S160.

The microcomputer 37 waits at S170 until the output Co4 of the comparator 45-4 changes from the high-level to the low-level. When the output Co4 changes from the high-level to the low-level, the microcomputer 37 determines that the coil current I fell to the comparison threshold value I4 and executes S180. The microcomputer 37 stores at S180 this time t4 in the RAM 43 and then executes S190.

Thus, the fall of the coil current I to the comparison threshold value I4 is detected by S170 and this time t4 (time t4 in FIG. 3) is stored in the RAM 43 by S180.

The microcomputer 37 waits at S190 until the output Co5 of the comparator 45-5 changes from the high-level to the low-level. When the output Co5 changes from the high-level to the low-level, the microcomputer 37 determines that the coil current I fell to the comparison threshold value I5 and executes S200. The microcomputer 37 stores at S200 this time t5 in the RAM 43 and then executes S210.

Thus, the fall of the coil current I to the comparison threshold value I5 is detected by S190 and this time t5 (time t5 in FIG. 3) is stored in the RAM 43 by S200.

The microcomputer 37 waits at S210 until the output Co6 of the comparator 45-6 changes from the high-level to the low-level. When the output Co6 changes from the high-level to the low-level, the microcomputer 37 determines that the coil current I fell to the comparison threshold value I6 and executes S220. The microcomputer 37 stores at S220 this time t6 in the RAM 43 and then executes S230.

Thus, the fall of the coil current I to the comparison threshold value I6 is detected by S210 and this time t6 (time t6 in FIG. 3) is stored in the RAM 43 by S220.

The microcomputer 37 then calculates at S230 time intervals (time differences) ta, tb, tc, td, te of times t1 to t6 stored in the RAM 43 at S120, S140, S160, S180, S200, S220, respectively. As shown in FIG. 3, ta is a time interval between t1 and t2, tb is a time interval between t2 and t3, tc is a time interval between t3 and t4, td is a time interval between t4 and t5 and te is a time interval between t5 and t6.

The microcomputer 37 then detects at S240 the valve-closing time of the injector 15 based on the calculated time intervals ta to te calculated at S230. More specifically, each of the time intervals ta to te is a time interval required for the coil I to decrease by an amount of the difference ΔI between the adjacent two comparison threshold values I1 to I6. This time interval is in inverse proportion to a rate of decrease of the coil current I per time. Since the coil current I rapidly decreases at the valve-closing time as described above, the valve-closing time can be detected to be the time, at which the decrease rate of the coil current I changes from decreasing to increasing. The decrease rate of the coil current I gradually approaches to 0 at a time just immediately before the decrease rate of the coil current I changes from decreasing to increasing. For this reason, the interval required for the coil current I to decrease by the amount of the difference ΔI becomes longer than before at the time immediately before the valve-closing time.

The microcomputer 37 therefore determines at S240 which of the time intervals ta to te is longer than a predetermined reference value, and detects, as the valve-closing time, the time of attaining the threshold value corresponding to the end of the determined time interval. In the example of FIG. 3, the time interval tc is determined to be longer than the reference value and the time t4 is detected as the valve-closing time.

Alternatively, it is possible to compare the time intervals ta to te and specify the time interval, which is shorter than the preceding time interval. The time of attaining the threshold value, which corresponds to the start point of the specified time interval, is detected as the valve-closing time. In the example of FIG. 3, the time interval td is determined to be shorter than the preceding time interval tc and also in this case the time t4 is detected as the valve-closing time.

The microcomputer 37 then calculates at the following S250, a correction value for correcting the high-level period (pulse width) of the power supply command signal S#1 based on the valve-closing time detected at S240. More specifically, a period from the fall time of the power supply command signal S#1 to the valve-closing time detected at S240 is calculated as a valve-closing delay period Tcd (that is, delay period from falling of the power supply command signal S#1 to valve-closing of the injector 15). However, since each threshold value attaining time t1 to t6 and the valve-closing time are detected as the timer values indicating the time relative to the fall time of the power supply command signal S#1, the timer value itself detected as the valve-closing time at S240 may be used as the valve-closing delay period Tc.

Then, for example, a difference (Tcd−Tcr) between the calculated valve-closing delay period Tcd and the reference value Tcr of the valve-closing period is calculated. This calculated difference (that is, error in the valve-closing period of individual injector) is stored in the RAM 43 as the correction value for the high-level period of the power supply command signal S#1, with respect to which the valve-closing time is detected this time. The correction value may be stored in, for example, a rewritable non-volatile memory (not shown) such as a flash memory or EEPROM.

The microcomputer 37 finishes the valve-closing time detection processing after executing S250. In the fuel injection control processing (not shown), the microcomputer 37 corrects a basic value of the drive period by the correction value in determining the drive period of the injector 15 (high-level period of the power supply command signal S#1). The basic value of the drive period is calculated based on the operation information such as an engine rotation speed in the conventional manner. The correction value is selected from the correction values, which are stored in the RAM 43 and the like at S250, in correspondence to the basic value of the drive period. For example, the drive period to be used for actually driving the injector 15 is set to be a period, which is determined by shortening the basic value of the drive period by the amount of the selected correction value.

Alternatively, at S250 in FIG. 4, the correction value may be calculated based on the calculated valve-closing delay period Tcd so that the correction value is used in common for all drive periods. Further alternatively, not only the correction value to be used for the drive period, with respect to which the valve-closing time is detected presently, other correction values to be used for other similar drive periods may also be calculated. The former method is effective in such a case that the valve-closing delay period caused when the injector 15 is driven with a certain drive period will not differ so much in precision from valve-closing delay periods caused when the injector 15 is driven with other drive periods. The latter method is realized by predicting, from the valve-closing delay period caused when the injector 15 is driven with a certain drive period, other valve-closing delay periods caused when the injector is driven with other drive periods based on arithmetic calculation, stored map data and the like. That is, any methods may be used for calculating the correction value for the drive period (high-level period of the power supply command signal) and correcting the drive period by using the correction value.

According to the fuel injection control apparatus 11 described above, the valve-closing time of the injector 15 can be detected without A/D conversion or differential operation of the coil current I. It is thus possible to avoid an increase in processing load caused by the differential operation or an additional use of an A/D conversion channel of the A/D converter 44.

Second Embodiment

A second embodiment will be described next. The description will be simplified by using the same reference numerals for the same or similar parts as in the first embodiment. This simplification is also made in other embodiments described later.

Figure 5:
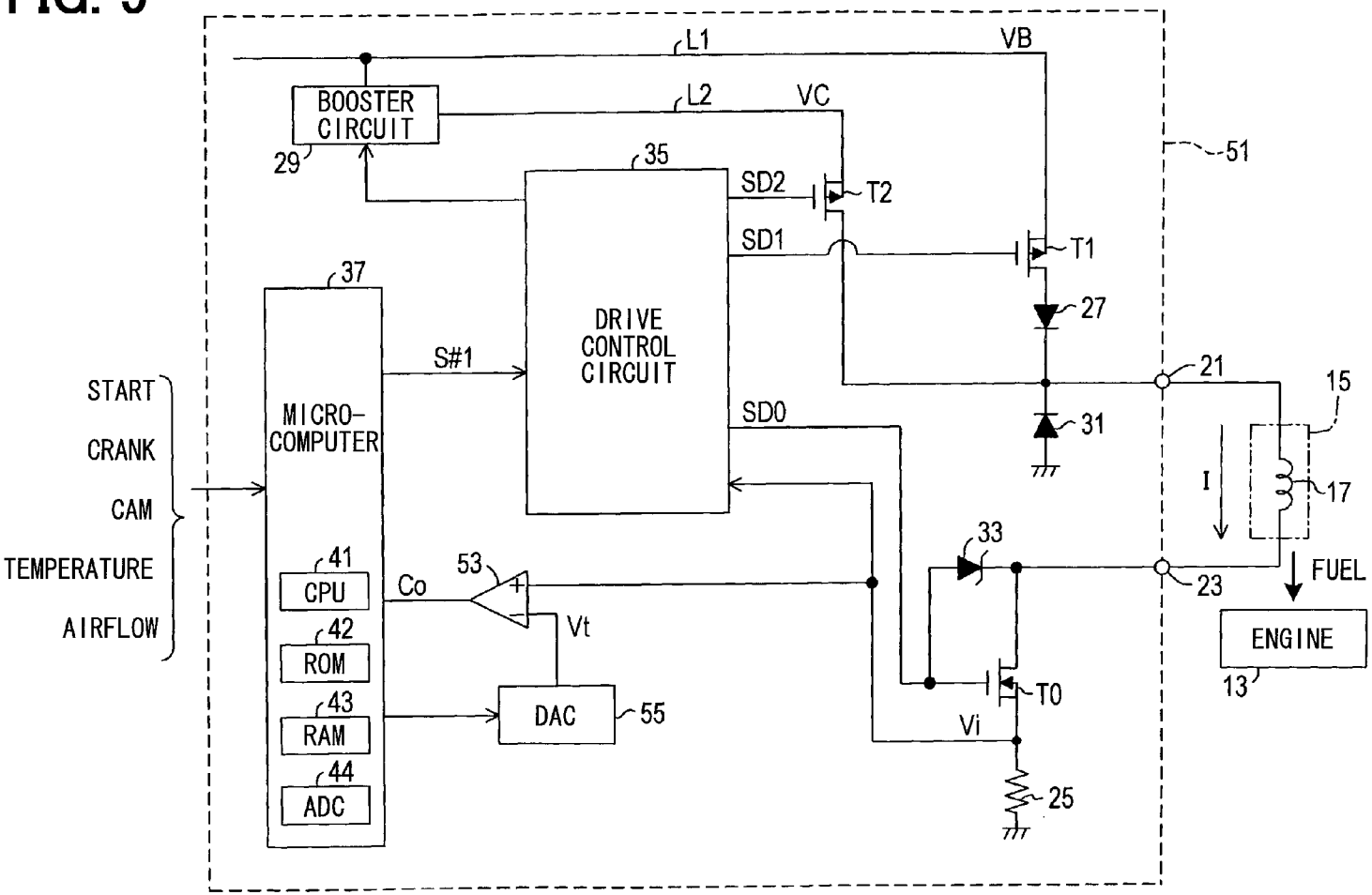
FIG. 5 is a circuit diagram showing a fuel injection control apparatus according to a second embodiment.

In comparison with the fuel injection control apparatus 11 according to the first embodiment, a fuel injection control apparatus 51 according to the second embodiment shown in FIG. 5 is different in hardware in that only one comparator 53 is provided in place of the plural comparators 45-1 to 45-6 and provided with a digital/analog converter (DAC) 55 as a part for generating the threshold value voltages V1 to V6 one by one in sequence by switchover.

The current detection voltage Vi is inputted form the resistor 25 to a non-inverting input terminal of the comparator 53 in the similar manner as the comparators 45-1 to 45-6 of the first embodiment. The comparator 53 compares the current detection voltage Vi with a comparison threshold value voltage Vt inputted to an inverting input terminal. The comparator 53 sets its output Co to a high-level and to a low level in response to Vi>Vt and Vi≤Vt, respectively. The output Co of the comparator 53 is inputted to the microcomputer 37.

The D/A converter 55 outputs the threshold value voltage V1 to V6 one by one by switchover in accordance with the output data of the microcomputer 37. The output voltage of the D/A converter 55 is inputted to the inverting input terminal of the comparator 53 as the comparison threshold value voltage Vt.

Figure 6:
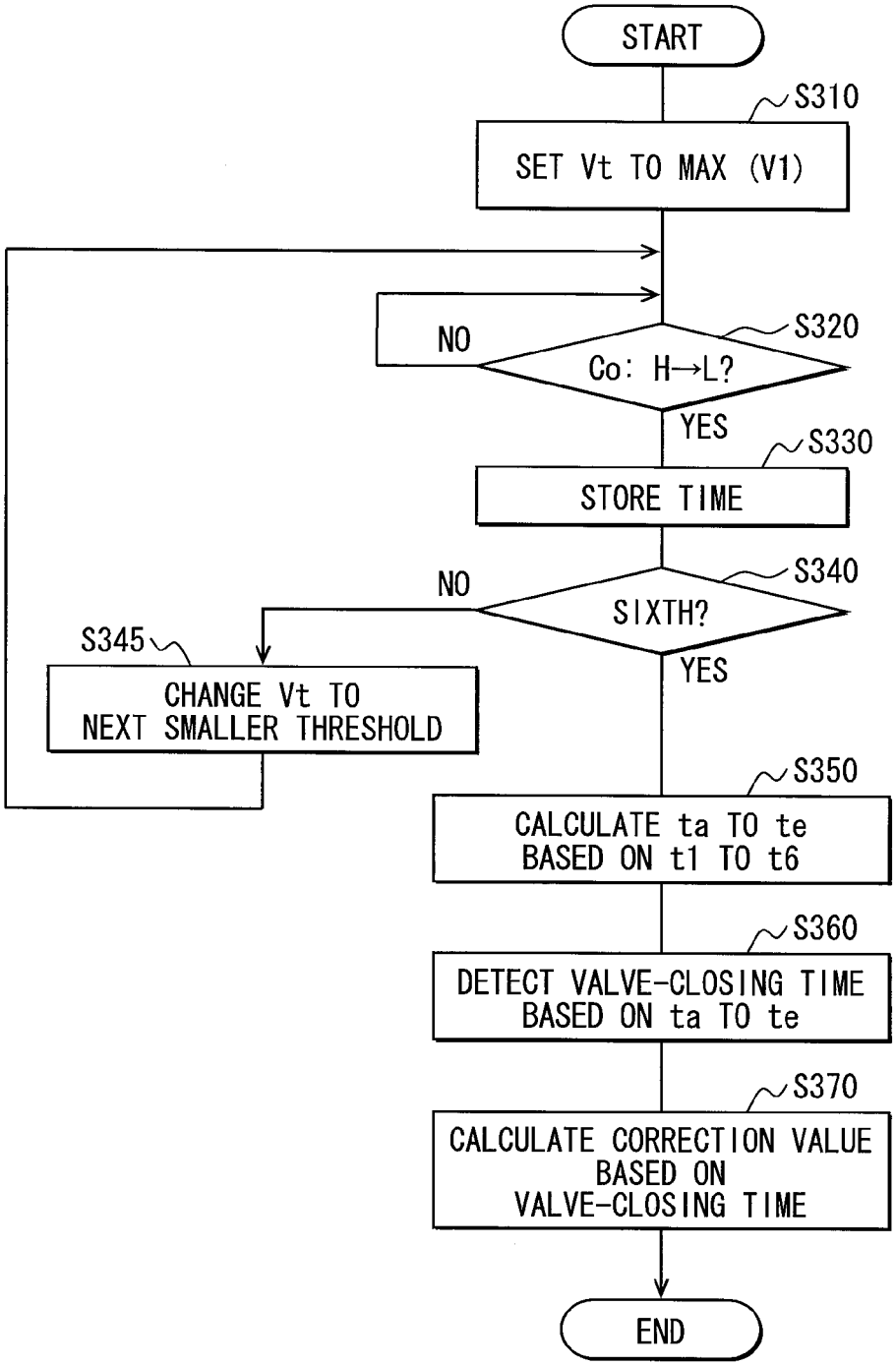
FIG. 6 is a flowchart showing valve closing time detection processing executed by a microcomputer in the second embodiment.

In comparison to the fuel injection control apparatus 11 according to the first embodiment, the fuel injection control apparatus 51 according to the second embodiment is different in that the microcomputer 37 performs valve-closing time detection processing shown in FIG. 6 in place of the processing shown in FIG. 4.

As shown in FIG. 6, the microcomputer 37 sets the comparison threshold value voltage Vt (that is, output voltage of the D/A converter 55) to the maximum threshold value voltage V1 among the threshold value voltages V1 to V6 at S310 after starting to execute the valve-closing time detection processing.

The microcomputer 37 then waits at S320 until the output Co of the comparator 53 changes from the high-level to the low-level. When the output Co of the comparator 53 changes from the high-level to the low-level, the microcomputer 37 determines that the coil current I fell to the comparison threshold value voltage Vt and executes S330.

The microcomputer 37 stores at S330 the present time in the RAM 43. In also the second embodiment, the microcomputer 37 resets the time-measuring timer at the start time of the valve-closing time detection processing (that is, the fall time of the power supply command signal S#1). The microcomputer 37 stores at S330 the timer value in the RAM 43 as the present time, which is measured relative to the fall time of the power supply command signal S#1 as the reference.

Then at S340, the microcomputer 37 checks whether time storing is repeated the same number of times as the number of the threshold value voltages V1 to V6 (also the number of the comparison threshold values I1 to I6, and 6 according to the present embodiment). If the time storing is not executed 6 times, S345 is executed.

At S345, the microcomputer 37 changes the comparison threshold value voltage Vt inputted to the comparator 53 to a threshold value voltage, which is next smaller than the present value, among the threshold value voltages V1 to V6. For example, if the present value of the comparison threshold value voltage Vt is V1, the comparison threshold value voltage Vt is changed to V2. If the present value is V2, it is changed to V3. If the present value is V5, it is changed to V6. Then S320 and the subsequent steps are repeated again.

By the processing of S310 to S345, each time the current detection voltage Vi decreases to any one of the threshold value voltages V1 to V6 (that is, each time the coil current I decreases to the comparison threshold value I1 to I6), such a time is stored in the RAM 43. Further, the comparison threshold value voltage Vt inputted to the comparator 53 is switched to a threshold value voltage, which is next smaller than the threshold vale voltage which the current detection voltage Vi attained. When S345 is repeated 5 times and S320 and S330 are repeated 6 times, similarly to the first embodiment, the time of decrease of the coil current I to each of the comparison threshold values I1 to I6 (threshold value attaining time) is detected. Such each time t1 to t6 are stored in the RAM 43.

When the microcomputer 37 determines at S340 that time storing is executed 6 times, the microcomputer 37 executes S350, S360, S370, which are similar to S230, S240 and S250 of FIG. 4, thereby to calculate the valve-closing time and calculates the correction value. Then the microcomputer 37 calculates the valve-closing time and thereafter finishes the valve-closing tine detection processing.

As described above, in the fuel injection control apparatus 51 according to the second embodiment, the comparator 53 compares the coil current I with each comparison threshold value I1 to I6 by switching over the comparison threshold value voltage Vt inputted to the comparator 53 to each of the plural threshold value voltages V1 to V6.

As a result, in comparison with the first embodiment, the number of the comparators is reduced to one irrespective of the number of comparison threshold values. That is, even if the resolving power of detecting the valve-closing time is improved by increasing the number of the comparison threshold values, only one comparator is needed.

The part for switching over the comparison threshold value voltage Vt to each of the threshold value voltages V1 to V6 is not limited to the D/A converter 55. It may be formed of, for example, seven resistors R1 to R7 shown in FIG. 1 and a multiplexer (switchover circuit), which selects and outputs to the inverting input terminal of the comparator 53 by selecting any one of the threshold value voltages V1 to V6 generated by the resistors R1 to R7 in accordance with a selection signal provided from the computer 53.

Third Embodiment

A fuel injection control apparatus according to a third embodiment is the same in configuration as the fuel injection control apparatus 51 of the second embodiment. Therefore the fuel injection control apparatus according to the third embodiment is denoted by the same reference numeral 51 as in the second embodiment.

Figure 7:
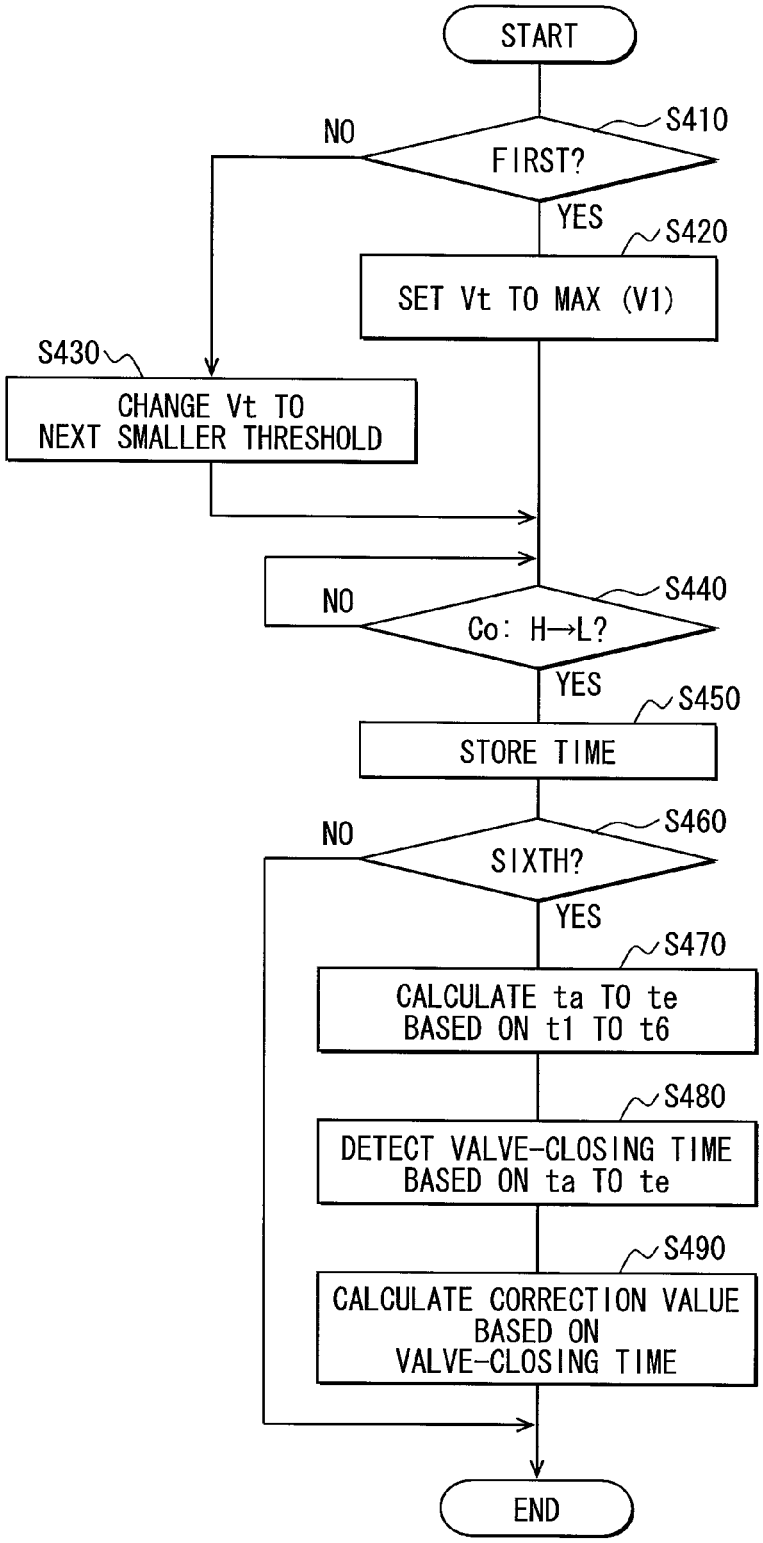
FIG. 7 is a flowchart showing valve closing time detection processing executed by a microcomputer in a third embodiment.

In comparison with the fuel injection control apparatus 51 according to the second embodiment, the fuel injection control apparatus 51 according to the third embodiment is different in that the microcomputer 37 executes valve-closing time detection processing shown in FIG. 7, not the processing shown in FIG. 6, as the processing for detecting the valve-closing time of the injector 15.

In the first and the second embodiments, the time of attaining each threshold value is detected in one current decrease period, which starts from the end time of the drive period and ends when the coil current becomes 0. In the third embodiment, however, the time of attaining each threshold value (valve-closing time of the injector 15) is detected by using plural number of current decrease periods (in the following example, as many as six current decrease periods as the number of the comparison threshold values I1 to I6).

Specifically, the microcomputer 37 executes the valve-closing time detection processing shown in FIG. 7 at every fall time of the power supply command signals S#1 for six fuel injections, among which the coil current values I at the end of the drive periods are considered to be the same (that is, the waveforms of the coil currents from the ends of the drive periods become the same). As the fuel injections, among which the coil currents I at the ends of the drive periods are the same, fuel injections of the same high-level periods of the power supply command signals S#1 are assumed.

For this reason, execution of the valve-closing time detection processing shown in FIG. 7 is started, for example, at every fall of the power supply command signal S#1 having the high-level period, which is set to the specified value by the fuel injection control processing described above. The microcomputer 37 detects the valve-closing time of the injector 15 by executing the valve-closing time detection processing six times.

As shown in FIG. 7, the microcomputer 37 first checks at S410 whether the present execution of this processing is the first one of the six executions. If it is the first execution, the microcomputer 37 executes S420 and sets the comparison threshold value voltage Vt inputted to the comparator 53 (that is, the output voltage of the D/A converter 55) to the maximum threshold value voltage V1 among the threshold value voltages V1 to V6. The microcomputer 37 then executes S440.

If it is determined that this execution of the processing is not the first one of the six executions (that is, any one of the second to the sixth execution), the computer executes S430 and changes the comparison threshold value voltage Vt inputted to the comparator 53 to one of the threshold value voltages V1 to V6, which is next smaller than the present value. For example, if the present value of the comparison threshold value voltage Vt is V1, it is changed to V2. If the present value is V5, it is changed to V6. The microcomputer 37 then executes S440.

By execution of S410 to S430, the comparison threshold value voltage Vt inputted to the comparator 53 is switched over orderly from V1 to V6 through V2, V3, V4 and V5.

The microcomputer 37 waits at S440 until the output Co of the comparator 53 changes from the high-level to the low-level. When the output Co of the comparator 53 changes from the high-level to the low-level, the microcomputer 37 determines that the coil current I decreased to the comparison threshold value voltage Vt and executes S450.

At S450 the microcomputer 37 stores this time in the RAM 43. In the third embodiment, the microcomputer 37 resets the time-measuring timer at the start time of the valve-closing time detection processing. The microcomputer 37 stores at S450 the timer value in the RAM 43 as the present time, which elapses from the fall time of the power supply command signal S#1 used as the reference time.

The microcomputer 37 checks at S460 whether this is the sixth execution of the detection processing. If it is not the sixth execution, the valve-closing time detection processing of this time is finished. If it is determined at S460 that this execution is the sixth one, the microcomputer 37 executes S470.

At this time, execution of S440 and S450 is finished six times. By the execution of S440 of six times, the times of falling of the coil current I to each of the comparison threshold values I1 to I6 are detected. By the execution of S450 six times, each detected time t1 to t6 are stored in the RAM 43.

When the microcomputer 37 executes S470 following S460, it executes S470, 5480, S490 in the similar manner as S230, S240, S250 to detect the valve-closing time and calculate the correction value. The microcomputer 37 thus finishes the valve-closing time detection processing.

In the fuel injection control apparatus 51 according to the third embodiment, the comparison threshold value voltage Vt inputted to the comparator is switched over among the threshold value voltages V1 to V6 at every one of six current decrease periods thereby to detect each time of attaining the threshold values.

The fuel injection control apparatus 51 according to the third embodiment also provides the same advantage as the fuel injection control apparatus 51 according to the second embodiment. The comparison threshold value voltage Vt is switched over among the threshold voltages V1 to V6 from the largest one to the smallest one orderly in the processing of FIG. 7. This order may be arbitrarily changed.

In the processing of FIG. 7, the comparison threshold value voltage Vt is switched over to one threshold value voltage at every execution of the processing. The comparison threshold value voltage Vt may, however, be switched over to plural threshold value voltages in one processing in the similar manner as the processing of FIG. 6. For example, the voltage Vt may be switched to two different threshold value voltages in one processing so that six valve-closing times may be detected in a total of three processing. That is, the number of switchover of the comparison threshold value voltage Vt at each current decrease period is not limited to 1 but may be other plural numbers, which are less than the total number (six) of the threshold value voltages to be switched over. It is the second embodiment that exemplifies the number of switchover of the comparison threshold value voltage Vt at each current decrease period to six.

The high-level period of the power supply command signal S#1 (specified value described above) as the condition for executing the valve-closing time detection processing of FIG. 7 may be plural. That is, the valve-closing time detection processing of FIG. 7 at the fall time of the power supply command signal S#1 having a first period of high-level may be started six times, and the valve-closing time detection processing of FIG. 7 at the fall time of the power supply command signal S#1 having a second period of high-level may be started six times. Thus the valve-closing time detection processing of FIG. 7 may be repeated six times for each of different fuel injections by the signals S#1, which have different high-level periods, respectively.

It is assumed that the maximum period from time the power supply command signal S#1 rises to time the coil current I is maintained at the constant current required to maintain the valve-opening by the above-described constant current control is $T_{max}$. If the high-level period of the power supply command signal S#1 is longer than $T_{max}$, the coil current I at the end of the drive period is the constant current required to maintain the valve open irrespective of the high-level period. For this reason, the valve-closing time detection processing of FIG. 7 may be started at every time of the rise of the power supply command signal S#1, which has the high-level period longer than Tmax.

Other Embodiment

The fuel injection control apparatus described above may be implemented in various other ways.

For example, the differences between the two adjacent comparison threshold values I1 to I6 (threshold value voltages V1 to V6) need not be equal.

One example of this will be described is a case of the first embodiment. In this example, the differences between the adjacent two of the comparison threshold values I1 to I6 (threshold value differences) are assumed to be Δ1, Δ2, Δ3, Δ4, Δ5. At S240, as the target to be checked whether it is equal to or larger than the reference value or to be compared thereamong, the time difference (time interval) ta is used as it is and the time differences tb, tc, td and te may be determined by multiplying the time difference ta by Δ2/Δ1, Δ3/Δ1, Δ4/Δ1 and Δ5/Δ1, respectively. That is, a ratio of each threshold value difference relative to a reference difference, which is any one of the differences of the comparison threshold values I1 to I6 (in this example, Δ1), is determined. The time difference corresponding to each threshold value difference is multiplied by the calculated ratio as a weighting factor. This example may also be applied in other embodiments.

If the comparison threshold values I1 to I6 are equally spaced, the above-exemplified weighting need not be made. In the first and the second embodiments, the time to be stored in the RAM 43 as the threshold-attaining time need not be the time, which is determined based on the fall time of the power supply command signal S#1 as the reference time. For example at S120, S140, S160, S180, S200, S220 in FIG. 4 and S330 in FIG. 6, a value of a timer (specifically, a freerun timer in the microcomputer 37 or other time-measuring timer), which is not reset at the fall time of the power supply command signal S#1, may be stored. This is because, in the first and the second embodiments, each threshold-attaining time is detected in one current decrease period. Therefore, whichever time is stored as the reference time, each of the time differences ta to te among the threshold-attaining times can be calculated. In addition, the fall time of the power supply command signal S#1, which is immediately before each threshold-attaining time, is only one and known. Therefore, the valve-closing time can be calculated based on the fall time of the power supply command signal S#1 as the reference time.

In a case that the microcomputer 37 executes the valve-closing time detection processing (FIG. 4, FIG. 6 and FIG. 7) in the above-described embodiments, the time for turning off the transistor T0 by the drive control circuit 35 (time of changing the drive signal SD0 from the high-level to the low-level and referred to as off time) may be delayed from the fall time of the power supply command signal S#1 by a predetermined delay period.

This is because, if the turn-off time of the transistor T0 is delayed from the fall time of the power supply command signal S#1, one of the transistors T1 and T2, which is in the on-state, is turned off with the transistor T0 in the on-state. The current flows to the coil 17 through the diode 31 without the Zener diode 33 functioning as the arc-suppressing part. For this reason, in comparison to a case that the turn-off time of the transistor T0 is not delayed, the coil current I slowly decreases and the current decrease period becomes longer. The waveform of the coil current I is likely to change in correspondence to changes in the characteristics of the injector 15. As a result, the valve-closing time can be detected more readily and the accuracy of detection can be improved. The delay period is only required to be longer than the maximum period from the fall time of the power supply command signal S#1 to the zero-current time, at which the coil current I falls to 0. That is, the turn-off time of the transistor T0 is only required to be delayed until zero-current time, that is, until the coil current I becomes 0.

What is claimed is:

1. A fuel injection control apparatus for an injector having a coil and a valve, the fuel injection control apparatus comprising:

a setting part for setting a drive period of the injector;

a drive control part for driving the injector to open the valve by starting a power supply operation of supplying a power voltage to the coil of the injector to supply a current to the coil at a start time of the drive period set by the setting part, and for stopping the power supply operation to close the valve at an end time of the drive period;

a detection part for detecting a valve-closing time of the injector based on the coil current, which decreases from the end time of the drive period, wherein:

the detection part detects, after the end time of the drive period and by sequentially comparing the coil current with each of plural comparison threshold values, each time that the coil current decreases to each of the plural comparison threshold values, and detects the valve-closing time based on detected times, and the plural comparison threshold values are provided for comparison with the coil current after the end time of the drive period.

2. The fuel injection control apparatus according to claim 1, wherein:

the detection part detects the valve-closing time based on a time difference between the detected times.

3. The fuel injection control apparatus according to claim 1, wherein:

the plural comparison threshold values are equally spaced thereamong.

4. The fuel injection control apparatus according to claim 1, wherein:

the detection part includes a conversion part for converting the coil current to a voltage, and plural comparators provided in correspondence to the plural comparison threshold values for comparing the voltage outputted by the conversion part with comparison threshold value voltages, which are inputted to the plural comparators in correspondence to the plural threshold values, respectively; and the plural comparators compare the coil current with the plural comparison threshold values.

5. The fuel injection control apparatus according to claim 1, wherein:

the detection part includes a conversion part for converting the coil current to a voltage, and a comparator for comparing the voltage outputted by the conversion part with a comparison threshold value voltage, which is inputted to the comparator and switched over to correspond to the plural comparison threshold values.

6. The fuel injection control apparatus according to claim 1, wherein:

the detection part detects each of the detection times in one current decrease period from the end time of the drive period to a zero-current time, at which the coil current decreases to 0.

7. The fuel injection control apparatus according to claim 5, wherein:

the detection part detects the each detection time as a period, which is measured from the end time of the drive period as a reference time; and the detection part detects the each detection time by switching over the comparison threshold value voltage inputted to the comparator to any one or more of the plural threshold value voltages at each of plural current decrease periods starting from the end time of the drive period to the zero-current time.

8. The fuel injection control apparatus according to claim 1, wherein:

the detection part calculates rates of decrease of the coil current per time based on the plural comparison threshold values and the detected times and detects the valve-closing time based on a change of direction of the rates of decrease from decreasing to increasing.

9. The fuel injection control apparatus according to claim 8, wherein:

the plural comparison threshold values are equally spaced thereamong; and the detection part calculates, as the rates of decrease of the coil current per time, time differences between the detected times, which are detected successively, and detects the valve-closing time based on a time, at which a calculated time difference becomes shorter than a preceding calculated time difference.

10. The fuel injection control apparatus according to claim 8, wherein:

the setting part sets the drive period of the injector by using the detected valve-closing time.

11. The fuel injection control apparatus according to claim 1, wherein:

the detection part includes a resistor connected to the coil to detect the coil current.

12. The fuel injection control apparatus according to claim 1, wherein:

the plural threshold values are three or more in number.

* * * * *